US006014783A

United States Patent [19]

Collier et al.

[11] Patent Number: 6,014,783

[45] Date of Patent: Jan. 18, 2000

[54] RIGID BACKED PNEUMATIC CUSHION FOR CONVALESCENT RECLINERS

[76] Inventors: David Collier; Clint Guillot; Peter Harris, all of 719 C Burnside Ave., Gonzales, La. 70737

[21] Appl. No.: 09/200,705

[22] Filed: Nov. 27, 1998

[51] Int. Cl.[7] ..... A61G 7/015; A61G 7/05; A47C 27/08

[52] U.S. Cl. ..... 5/618; 5/723; 5/654; 5/706; 5/655.3; 297/440.2; 297/440.22

[58] Field of Search ..... 5/618, 654, 706, 5/710, 723, 655.3, 691; 297/440.22, 440.2, 423.4

[56] References Cited

U.S. PATENT DOCUMENTS

| | | | |
|---|---|---|---|
| 558,605 | 4/1896 | Gimbel | 5/655.3 |
| 2,860,937 | 11/1958 | Einstein et al. | 5/723 |
| 5,333,921 | 8/1994 | Dinsmoor, III | 5/654 |
| 5,461,741 | 10/1995 | Graebe | 5/654 |
| 5,592,706 | 1/1997 | Pearce | 5/654 |
| 5,745,941 | 5/1998 | Miller, Sr. | 5/691 |

FOREIGN PATENT DOCUMENTS

| | | | |
|---|---|---|---|
| 262574 | 12/1926 | United Kingdom | 5/655.3 |

*Primary Examiner*—Alexander Grosz
*Attorney, Agent, or Firm*—Peter Gibson

[57] ABSTRACT

A cushion having multiple pneumatic cells extending upward from a common impermeable base is directly attached to a flat rigid base which is fixedly attached to each of three subframes of a convalescent recliner. Male and female snap fasteners are suggested. The direct attachment of the cushion to the flat rigid base disposes the bottom of the common impermeable base flush with the top of the flat rigid base. Upper attachment elements are located upon the bottom of the common impermeable base which mate with lower attachment elements located upon the top of the flat rigid base. Both upper and lower attachment elements are located in a single fixed configuration. An absorbent elastic cover fits over the cushion, is readily removable, and has a hem which fits about the periphery of the bottom of the cushion, outside of the fixed configuration of upper fastening elements. An ischemic preventive support cushion which will not shift as a result of inclination is provided. It is suggested that the flat rigid base be constructed of wood and fixedly attached to a subframe with screws.

9 Claims, 2 Drawing Sheets

FIG 4
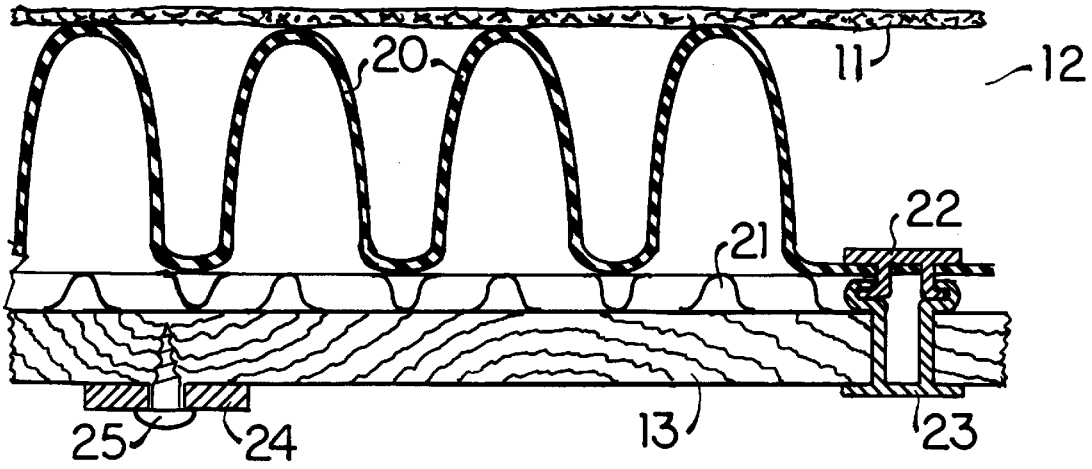
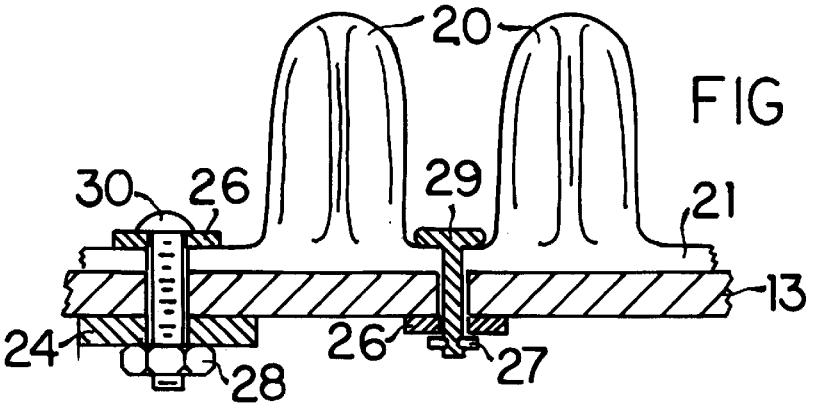
FIG 5
FIG 6
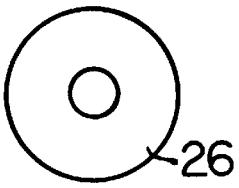
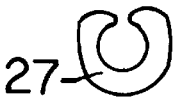
FIG 7

RIGID BACKED PNEUMATIC CUSHION FOR CONVALESCENT RECLINERS

BACKGROUND OF THE INVENTION

1. Field of the Invention

The present invention relates generally to devices concerned with support of a person's body in a manner minimizing ischemic injury, more particularly to such devices utilizing a plurality of vertically oriented inflated cushions forming a substantially continuous surface underneath a patient's body providing buoyant support, and specifically to such devices which may be utilized upon a structure possessing inclined support surfaces such as a convalescent recliner.

2. General Background

Ischemia, which is commonly manifested by bed sores, is caused by vascular deformation which typically results from the internal pressure of interstitial fluid which characterizes swollen tissue. In order to avoid this condition, minimize the extent of the same and reduce the severity of developed ischemia, substantially uniform external pressure in the range of 20–80 mm Hg psig is desired. Localization of external pressure is, most importantly, to be avoided.

The prevention of ischemic ulcers, i.e. pressure sores, is perhaps best or most commonly achieved with a support surface which maximizes the distribution of external pressures. A support surface which conforms readily to the contours of a patient's body and which adjusts to changes in the tissues concerned over time promotes healing of ischemia by evenly distributing external pressure upon the body. Edema is reduced, over time, by moderate, evenly distributed, external pressure. Edema reduction returns capillarial proximity to afflicted tissue which, in turn, increases blood flow and nutrient supply to that tissue thereby reversing ischemia and ameliorating the deleterious effects of the same.

Discussion of the Prior Art

One of the most successful approaches to achieving the exertion of substantially equal external pressure upon a convalescent's body with a support surface which conforms and adjusts to the contours of those portions of that body contacted by said support surface is found in the utilization of a plurality of vertically oriented partially inflated cells positioned to contact each other horizontally. Devices of this type are economically manufactured by utilizing a form or mold of the type described in U.S. Pat. No. 3,870,450 entitled 'Multicelled Structure Apparatus for Making Same' which discloses use of multiple fluted mandrels extending upward from a common base and which results in a plurality of fluted, vertically oriented pneumatic cells, either connected pneumatically or individually isolated, all disposed proximate each other such that moderate internal fluid pressure brings the cells into contact with each other horizontally and a substantially continuous support surface possessing the desirable characteristics described above is obtained.

Of course many other approaches are known including a number also considered pertinent to the present invention. U.S. Pat. No. 2,548,547 for a 'Sectional Pad' issued Apr. 10, 1951 to Robert L. Melrose discloses use of a plurality of block shaped cushions peripherally flanged along the bottom presenting, along opposed edges, fastening elements oriented either upward or downward, permitting the joining of adjacent units together into an extensive pad and "selective removal of any unit thereby forming a hole extending completely through said pad" (Column 1, Lines 26–28).

"(U)ndesirable pressure on any given portion of the body" is eliminated while providing "adequate and comfortable support to a reclining individual" (Column 1, Lines 15–18).

Use of pneumatic cells, horizontally disposed between a rigid base underneath and an elastomeric layer above, is disclosed by Albert E. Forsyth in U.S. Pat. No. 2,627,302 and No. 2,672,183. An additional layer of felt above the elastomeric is disclosed and upholstery fabric, peripherally fastened to the base, envelopes these several layers. A similar construction, also adapted for use on an inclined surface such as the back of a chair, is disclosed by Boyd S. Moore in U.S. Pat. No. 3,192,541 entitled 'Contourable Pneumatic Cushions'. The plurality of laterally adjacent air cells each have a valve controlled connection to a common plenum which enables selective adjustment of the inflation of each relative to the others.

Clark Morrison and Charles F. Stoyka disclose a 'Wheelchair Seating System' in U.S. Pat. No. 5,088,747 issued Feb. 18, 1992 which provides both the sling type horizontal seat support and the sling back of a collapsible chair having lateral rigid frame structures with a cushion inclusive of foam, gel, and felt like material with a removable rigid platform which straddles the opposed frame structures. Hook and loop material fasteners of the Velcro™ type are shown for holding the cushion to the sling seat or back while a board is optionally interposed therebetween.

Craig S. Miller, Sr. discloses an 'Air Support Mattress Overlay With Fitted Sheet Mounting' in U.S. Pat. No. 5,745,941 issued May 5, 1998 which utilizes a pliable base sheet having a top and sides which fits retentively on top of a mattress. At least one air conduit comprised of "impermeable sheet material is layered on the base sheet" and supplies, preferably through snap type male and female fasteners along said conduit, transversely oriented inflatable elements which are removably fastened to the base sheet, preferably with said snap fasteners. This rather recently disclosed apparatus is intended to fulfill certain deficiencies in conventional inflatable overlay systems including a "complicated external tubing manifold" (Column 1, line 39) and, more interestingly with regard to the problems presently addressed, it is stated that:

> Existing air support pad overlays lack a convenient means for attaching the overlay to the supporting mattress. Typically the overlay is attached by means of retaining straps engaged under the mattress. While this approach generally works, it is awkward and in some cases not entirely secure for keeping the overlay from shifting on the mattress. (Column 1, Lines 27–32)

Statement of Need

It is considered that a review of the pertinent prior art reveals two related concerns which have been inadequately addressed by the same. While support surfaces presented by partially inflated cells, particularly a plurality of vertically oriented cells in closed proximity, have been shown to be effective in ameliorating ischemia in the tissues of a convalescent's body contacted by the same, these structures are mainly intended for use as horizontal mattresses upon specially constructed beds, which are comparatively expensive in relation to ordinary or conventional beds. Inflatable overlays have a tendency to shift upon a conventional bed and wheelchairs present other difficulties.

Use of a fitted sheet has been disclosed as a means of preventing shifting of an inflatable overlay disposed upon a conventional bed which has an immobile horizontal support surface. Use of various pads attachable to the substantially horizontal seat and vertical back sling surfaces of a collapsible wheelchair has been disclosed. The interposition of a rigid surface, without attachment to either the pads or the sling structure, has been disclosed for the seat of such a system and implied for the back of the same though not shown. It is considered that the simple interposition of a board between a sling surface and a pad attached to the same would be problematic for the back because of the substantial inclination of the same from horizontal.

Convalescent recliners, mobile structures possessing three separate support surfaces each displaceable in a manner which obtains a range of inclination from nearly horizontal in those sections when fully reclined, are relatively neglected in the prior art. U.S. Pat. No. 5,715,548 for a 'Chairbed' discloses a structure including three sections. Horizontally disposed inflatable elements are automatically pressurized by an electric pump and pressure sensor system included in one integral stand alone structure incompatible with any other conventional structure. This is regarded as necessarily very expensive in comparison with a conventional convalescent recliner which is wholly manual in operation.

It is therefore considered that a need exists for a patient support surface which is effective in countering ischemia and which is applicable to a conventional convalescent recliner possessing three separate sections two of which are capable of being inclined from a substantially vertical to nearly horizontal disposition, which is wholly manual, i.e. does not require electricity for operation. In short, a need is hence recognized for a simple, inexpensive, device which will provide relief from ischemia in support of a convalescent which may be variably inclined.

SUMMARY OF THE INVENTION

Objects of the Invention

The encompassing object of the present invention is the provision of a support surface effective in the prevention of ischemia which is securely attachable to an existing manually inclinable structure.

An auxiliary object of the present invention is the provision of a support surface effective in the prevention of ischemia which possesses a substantially rigid, flat, base that is fixedly attached to an existing manually inclinable structure.

Another auxiliary object of the present invention is the provision of a support surface effective in the prevention of ischemia which is securely but removably attachable to a substantially rigid, flat, base that is securely attachable to an existing manually inclinable structure.

An ancillary object of the present invention is the provision of a support surface effective in the prevention of ischemia which is securely attachable to an existing manually inclinable structure which further possesses vapor permeable characteristics.

Another ancillary object of the present invention is the provision of a support surface effective in the prevention of ischemia which is securely attachable to an existing manually inclinable structure which further possesses vapor permeable characteristics which is readily removed from said existing structure in order to facilitate cleaning.

Further ancillary objects of the present invention include the provision of a support surface effective in the prevention of ischemia which is securely attachable to an existing manually inclinable structure which is: (a) of durable; (b) inexpensive; (c) flame retardant; (d) in possession of low shear and low friction characteristics; (e) easily maintained; (f) of low weight construction; (g) exclusive of a power supply; and (h) capable of customization particularly with regard to patients of varying weight and size.

Principles Relating to the Present Invention

It is first considered that an ischemic preventive support surface may be economically provided with utilization of multiple vertically oriented partially inflated pneumatic cells of sufficient proximity to present a substantially continuous surface which readily conforms to the contours of the body of a convalescent and which evenly distributes external pressure thereupon in contact therewith. It is secondly considered that a fabric covering thereto may be so constructed as to be readily removable and thereby easily cleaned which is vapor permeable and possesses low shear an low friction characteristics.

In order for a device utilizing these two components to provide a surface which is manually inclinable in secure attachment to an existing structure such as each of the three separate support sections of a convalescent recliner it is considered that a substantially flat, rigid, base is desired. Attachment of a cushion comprised of multiple vertically oriented pneumatic cells to such a flat rigid base is considered crucial to providing the desired capabilities. Shifting of the surface provided during inclination must be avoided. Direct attachment of the cushion to the base utilizing attachment means positioned between the two, directly underneath the cushion and directly above the base, is suggested. It is further recommended that the attachment between cushion and rigid base allow removal of the cushion from the base but that such attachment be unsusceptible to slippage and accidental disengagement.

The substantially flat, rigid, base, most importantly, enables a device in accordance with the principles relating to the present invention to constitute a replacement structure for that providing the support surfaces of a conventional convalescent recliner. Replacement is understood as being opposed to an overlay. In replacement the flat rigid base is fastened to the movable subframe portions of a convalescent recliner in the place of the ordinary support surface structures, back, seat and foot rests. Fastening, by use of screws, nuts and bolts or any other suitable means, directly to the subframes is essential to achieving a durable construction which will not come apart in use and which will not allow slippage of the cushion with respect to the recliner.

It is recommended that the substantially flat, rigid, base be constructed from a suitably thick sheet of plywood though other materials such as steel or aluminum sheet or epoxy resin or solid wood would suffice. Rigidity with regard to attachment to the subframe concerned is necessary and provision of a continuous, substantially flat, upper surface in flush contact with and as a substrate for the cushion disposed thereon and attached thereto is also regarded as necessary. These characteristics are required in order to provide the proper basis for an anchoring of the cushion achieved with direct attachment of the cushion to the base. It is recommended that his direct attachment be removable and that a margin about the entire periphery of the cushion underneath be provided in order to permit fitting of a fabric cover. Snap type fasteners, male and female, are preferred. It is further preferred that the cushion be constructed of flame retardant neoprene, and the cover be made from a combination of natural fibers such as cotton and an elastomeric.

BRIEF DESCRIPTION OF THE DRAWINGS

FIG. 4 is a partial cross sectional view of an assembly in accordance with the principles relating to the present invention.

FIG. 5 is a plain elevational view taken from the side of an alternative attachment means of an embodiment in accordance with the principles relating to the present invention.

FIG. 6 is a plain elevational view taken from the top of the washer depicted in FIG. 5.

FIG. 7 is a plain elevational view taken from the top of the clip depicted in FIG. 5.

DETAILED DESCRIPTION OF A PREFERRED EMBODIMENT

Figure 2:
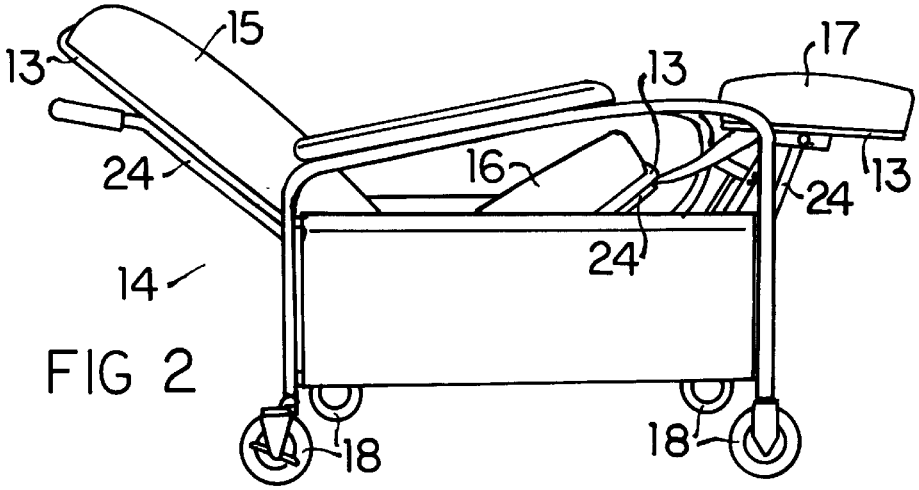
FIG. 2 is an isometric view taken from the side of the convalescent recliner of FIG. 1 possessing an embodiment of the principles relating to the present invention attached thereto in a fully reclined position.
Figure 1:
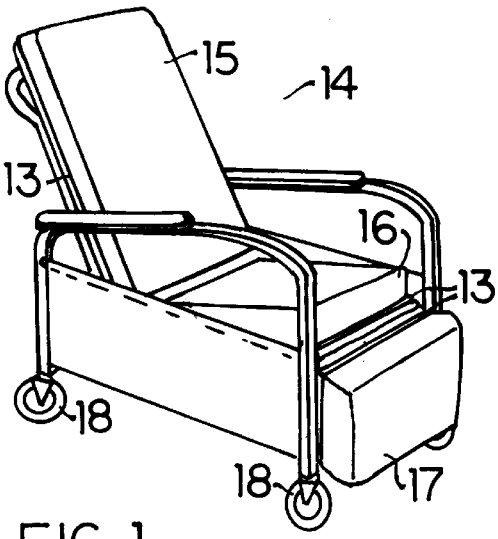
FIG. 1 is an isometric view taken from an angle of a convalescent recliner in a sitting position possessing an embodiment of the principles relating to the present invention attached thereto in replacement of the conventional back, seat, and foot rest structures providing support surfaces.

FIG. 1 depicts a convalescent recliner 14 possessing a back support surface 15, a seat support surface 16, and a foot support surface 17 each attached to a substantially flat, rigid, base 13 which is readily affixed to a subframe 24, one of which is seen in FIG. 2, all three being linked mechanically to enable an inclination displacement range as defined by the two extremes depicted in FIGS. 1 & 2. It will be observed that the foot support surface 17 in particular has a substantially vertical disposition in the seating position depicted in FIG. 1 and attains a nearly horizontal disposition in the fully reclined position depicted in FIG. 2. The range of inclination thus depicted is considered characteristic of what is known herein as a convalescent recliner 14 which further typically possesses an intermediate position which is not depicted. A convalescent recliner 14 possessing this range of inclination displacement and the mechanical linkage providing the same is not considered novel, per se, but the possession of back, seat, and foot support surfaces 15, 16, 17 which are each provided by a cushion 12 enveloped in a cover 11 and known herein as a covered cushion 10 as seen in FIG. 3 which are each further attached to a substantially flat, rigid, base 13 wherein each is comprised of a multiple pneumatic cell 20 structure as seen in FIGS. 4 & 5 directly attached to said base 13 is considered novel.

Figure 3:
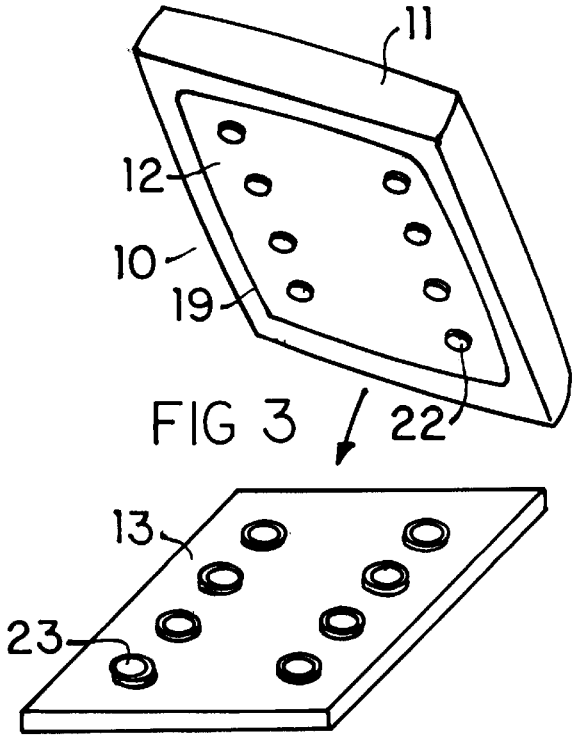
FIG. 3 is an isometric view of a preferred embodiment of the principles relating to the present invention with the cushion and cover separated from the base to illustrate the preferred attachment means.

As clearly seen in FIG. 3, each covered cushion 10 possesses upper attachment elements preferably each comprised of a male half 22 of a snap fastener and the substantially flat, rigid, base 13 possesses lower attachment elements preferably each comprised of a female half 23 of the snap fastener. The upper attachment elements are functionally presented by the bottom surface of the cushion 12 and the lower attachment elements are functionally presented by the top surface of the substantially flat rigid base 13, both disposed to mate in opposed pairs to provide a mechanical, preferably removable, i.e. detachable, means of attachment effecting a substantially flush disposition of the bottom surface of said cushion 12 with the top surface of said substantially flat rigid base 13.

It is not necessary that snap fasteners 22, 23 be utilized but that the fastening is effected by elements presented by opposed surfaces of the cushion 12 and the substantially flat rigid base 13 and the means of fastening is mechanical. An alternative fastening means is depicted in FIG. 5 utilizing a pin 29 which possesses an annular groove proximate the distal end about which a clip 27 is secure. A washer 26 is also utilized in this example which is shown in FIG. 6. The clip 27 utilized is further depicted in greater detail in FIG. 7 and is seen to comprise in this case what is commonly known as a snap ring. The clip 27 might be elongate and the groove about the distal end of the in 29 need not be annular but may comprise opposed notches. Other types of mechanical fasteners may be utilized such as a nut 28 and bolt 30 which is further depicted in FIG. 5 in attachment of the cushion 12 and the substantially flat rigid base 13 to a subframe 24.

It is preferred that the substantially flat rigid base 13 be rigidly affixed to the subframe 24 by separate means such as a screw 25 as depicted in FIG. 4 as it is considered desirable to be able to remove the covered cushion 10 from the substantially flat rigid base 13 without affecting the fixed attachment of the rigid base 13 to the subframe 24 of a convalescent recliner 14. Other means of affixing the substantially flat rigid base 13 to a subframe 24 may be utilized but the substantially flat rigid base 13 is preferably, as depicted in FIG. 4, constructed of wood, as opposed to the metal sheet depicted in FIG. 5 and the utilization of a wood screw 25 is considered the simplest means available in this case as the subframe 24 alone requires drilling to effect an aperture therethrough.

However, other means of affixing the substantially flat rigid base 13 to a subframe 24 separate from the attachment means utilized between opposed faces of the cushion 12 and the substantially flat rigid base 13 may readily be devised. The nut 28 and bolt 30 shown in FIG. 5 might, with or without a washer 26, capture the subframe 24 and the substantially flat rigid base 13 with the head of the bolt 30 disposed beneath the pneumatic cell base 21 rather than above the same. Another example, which is suited to fixed attachment of the cushion 12 to a substantially flat rigid base 13 constructed of any suitable material, is utilization of rivets, not shown, which will effect a relatively permanent fixed attachment.

It is further desired that the cover 11 be easily removed from the cushion 12 without removing the cushion 12 from the substantially flat rigid base 13. The preferred means for this is depicted in FIG. 3 wherein the upper attachment elements, comprised herein of male snap fasteners 22, are presented by the bottom surface of the cushion 12 within a peripheral margin of the same. This allows a cover 11, constructed as shown in FIG. 3, possessing an elastic hem 19 to be fitted upon the cushion with the hem 19 of the cover 11 disposed within this peripheral margin of the bottom surface of the cushion 12.

Alternatively, rather than using an elastic hem 19, a cover 11 might be comprised of upper and lower halves joined together peripherally with a zipper, or other suitable means, wholly enveloping the cushion 12. In this case apertures appropriately located through the lower half of the cover to accommodate the means of attaching the cushion 12 to the substantially flat rigid base might be introduced and the upper half of the cover 11 would be readily removable while leaving the lower half in place. Since the primary reason for desiring a readily removable cover 11 is in order to frequently clean the top surface of the same removal of the top half only will suffice. It is also desired, in any case, that the cover 11 be absorbent and vapor permeable in order to absorb fluids and remain comfortable. It is recommended that a cotton and Lycra™ or other combination of natural and elastic fabric be used for this reason.

In order to provide effective ischemic prevention the cushion 12 is comprised of multiple vertically disposed, i.e.

upright, pneumatic cells 20 as clearly depicted in FIG. 4. These pneumatic cells 20 are joined at the bottom to a common impermeable cell base 21 and are formed from an elastomeric as indicated in FIG. 4 in order to provide the characteristics necessary for substantially even pressure distribution against the contour of a body disposed upon the covered cushion 10.

The pneumatic cells 20 depicted in FIG. 4 are pneumatically connected to each other which allows air in the cells 20 to distribute according to the varying weight disposed upon the various pneumatic cells 20. This pneumatic connection between the plurality of pneumatic cells 20 is not necessary but is preferred. As long as each of the pneumatic cells 20 is partially inflated each may be closed and independent of the others. It is further recommended that, in the preferred case in which the pneumatic cells 20 are interconnected pneumatically, a single vale be provided which will permit inflation of the cushion 11 with a hand pump.

The preferred utilization of an embodiment in accordance with the principles relating to the present invention provides a convalescent recliner 14 with three separate rigid backed covered cushions 10 presenting ischemic preventive back, seat, and foot support surfaces 15, 16, 17 which are manually inclinable without significant shifting. A convalescent recliner 14 typically possesses four wheels 18, as seen in FIGS. 1 & 2, and has three mechanically linked subframes 24 which are manually displaceable throughout a given range. The seated position, depicted in FIG. 1, is mainly used in manual transport of a patient. The fully reclined position, depicted in FIG. 2, is often used to facilitate transfer of a patient to a bed. An intermediate position, not shown, is perhaps the most comfortable for the patient and is used typically for locations remote from a bed such as in a courtyard of a care facility so that the patient may enjoy the benefits of fresh air and sunlight in relative comfort.

The foregoing is intended to provide one practiced in the art with what is considered the best manner of making and using a preferred embodiment in accordance with the principles relating to the present invention and is not to be interpreted in any manner as restrictive of the scope of said invention or of the rights and privileges secured by Letters Patent protecting the same for which We hereby claim:

1. A structure intended to provide a support surface for a patient which is preventive of ischemia, said structure comprising:

a cushion, a cover, a substantially flat rigid base, and mechanical attachment means for directly attaching said cushion to said substantially flat rigid base comprised of a plurality of upper attachment elements and a plurality of lower attachment elements;

said cushion comprising a plurality of vertically oriented pneumatic cells possessing a common pneumatic cell base from which each said pneumatic cell extends upwardly with said common pneumatic cell base disposed substantially horizontally;

said cover fitting over said plurality of vertically oriented pneumatic cells and about said common pneumatic cell base;

said substantially flat rigid base being fixedly attached to a subframe of a convalescent recliner possessing three subframes;

said plurality of upper attachment elements being presented by a bottom face of said common pneumatic cell base in a direction opposed to the extension of said plurality of vertically oriented pneumatic cells and further disposed upon said bottom face interior to a peripheral margin of said bottom face in a fixed configuration;

said plurality of lower attachment elements being presented by a top face of said substantially flat rigid base in a fixed configuration matching said fixed configuration of said plurality of upper attachment elements;

each of said plurality of upper attachment elements mating with one of said plurality of lower attachment elements;

whereby mating of each of said plurality of upper attachment elements with one of said plurality of lower attachment elements mechanically attaches said cushion to said substantially flat rigid base with said bottom face of said common pneumatic cell base disposed substantially flush with said top face of said substantially flat rigid base thereby allowing inclination of said structure without significant shifting of said cushion with respect to said substantially flat rigid base and fixedly attached to a subframe of a convalescent recliner and mechanical attachment of one said cushion to said substantially flat rigid base with said cover fitted over said plurality of vertically oriented pneumatic cells and said common pneumatic cell base provides an ischemic preventive support surface for a patient which will not shift significantly with inclination of the same.

2. The structure of claim 1 wherein said substantially flat rigid base is constructed of wood.

3. The structure of claim 1 wherein said substantially flat rigid base is constructed of metal.

4. The structure of claim 1 wherein said cover possesses a hem located within said peripheral margin upon said bottom face of said common pneumatic cell base.

5. The structure of claim 4 wherein said hem of said cover is elastic.

6. The structure of claim 1 wherein said attachment means for directly attaching said cushion to said substantially flat rigid base is comprised of a plurality of male and female snap fastening elements.

7. The structure of claim 1 wherein said attachment means for directly attaching said cushion to said substantially flat rigid base is comprised of a plurality of pins and clips.

8. The structure of claim 1 wherein said substantially flat rigid base is fixedly attached to a subframe of a convalescent recliner by a plurality of nuts and bolts.

9. The structure of claim 1 wherein said convalescent recliner possesses four wheels.

* * * * *